US005222275A

United States Patent [19]

Baker et al.

[11] Patent Number: 5,222,275

[45] Date of Patent: Jun. 29, 1993

[54] BLOWER VACUUM

[75] Inventors: Michael Baker, Chandler; Harold Coleman, Phoenix, both of Ariz.

[73] Assignee: Ryobi Outdoor Products, Inc., Chandler, Ariz.

[21] Appl. No.: 887,464

[22] Filed: May 22, 1992

[51] Int. Cl.[5] ..... A47L 5/24

[52] U.S. Cl. ..... 15/329; 15/344; 15/405; 15/410

[58] Field of Search ..... 15/329, 344, 405, 410

[56] References Cited

U.S. PATENT DOCUMENTS

| | | | |
|---|---|---|---|
| Re. 33,050 | 9/1989 | Tuggle et al. | 15/330 |
| 3,711,742 | 1/1973 | Pinkham, Jr. | 312/2 R |
| 4,286,675 | 9/1981 | Tuggle | 173/163 |
| 4,325,163 | 4/1982 | Mattson et al. | 15/330 |
| 4,350,123 | 9/1982 | Kossek et al. | 123/2 |
| 4,644,606 | 2/1987 | Luerken et al. | 15/330 |
| 4,694,528 | 9/1987 | Comer et al. | 15/330 |
| 5,003,662 | 4/1991 | Everts | 15/330 |

OTHER PUBLICATIONS

IDC Blower VAC Parts Manual Model 300BV-2.

IDC Blower VAC Owner's Manual Model 300 BV.

*Primary Examiner*—Chris K. Moore

*Attorney, Agent, or Firm*—Brooks & Kushman

[57] ABSTRACT

A portable hand-held blower vacuum apparatus (10) having a hinged inlet cover (24) with a handle (26) disposed at one end of the cover (24). The cover (24) is moveable between a closed position where the cover spans an air inlet opening (20) and an open position to allow insertion of a vacuum tube (50) in to the inlet opening (20). The handle (26) is used to move the cover between the open and closed positions. Air flows into the inlet opening (20) through a screen (38) in the cover (24), through arcuate slots (42) in a tubular extension (44) of the inlet opening (20) and over a circumferentially extending rib (46) formed on the cover (24). In an alternative embodiment, a dedicated blower is provided in which a solid, stationary cover (54) spans the inlet opening (20).

4 Claims, 3 Drawing Sheets

BLOWER VACUUM

TECHNICAL FIELD

The present invention relates to a hand-held blower vacuum or dedicated blower. More particularly, the present invention relates to improvements in the inlet cover portion of such devices wherein a handle is provided on the blower vacuum air inlet cover.

BACKGROUND OF THE INVENTION

Portable hand-held blowers, commonly referred to as leaf blowers, have become indispensable home maintenance products for a wide variety of tasks. Commercial landscapers also use these devices, especially for spring and fall clean-up services. Blowers which can convert to vacuums provide an added degree of versatility to this product.

A convertible blower vacuum is a device which can be used as a blower or converted to operate as a vacuum. Conversion involves merely assembling a vacuum tube to the air inlet to direct the suction and placing a bag over the air outlet to collect the accumulated dust. An example of one such prior art device is disclosed in U.S. Pat. No. Re. 33,050 which issued to Tuggle. The Tuggle patent discloses a convertible gasoline powered blower vacuum wherein a saucer-shaped cover having an upturned rim is used to prevent pebbles from being drawn into the inlet opening during operation of the device in the blower mode. The base of the cover is solid and air is forced to flow upwardly above the rim of the cover prior to entry into the air inlet of the housing. The cover pivots at one end to allow insertion of the vacuum tube into the air inlet opening. Only a single handle is provided on the housing, even though the device is intended to be used in two entirely different orientations for blowing and for vacuuming.

The inlet cover is opened for insertion of the vacuum tube, by gripping the cover by its perimeter while sliding the vacuum tube into the inlet. This can be inconvenient because it is difficult to grasp the perimeter of the inlet cover while inserting the vacuum tube.

Air flows in an S-shaped path indirectly into the air inlet in the invention disclosed in the Tuggle patent. The solid bottom cover prevents air flow directly into the air inlet. As a result, air flow is restricted to the S-shaped path over the up-turned end of the inlet cover and below the tubular extension of the air inlet.

These and other problems and disadvantages encountered by the prior art are overcome by the present invention as summarized below.

DISCLOSURE OF THE INVENTION

According to the present invention, a hand-held combination blower and vacuum apparatus is disclosed wherein the housing encloses a motor and an impeller which is operatively connected to the motor. The impeller is disposed in an air-flow duct portion of the housing. The air-flow duct defines an air inlet and an air outlet through which air is moved during operation of the blower vacuum. A cover for the air inlet is pivotably attached to the housing and can be moved between a closed position wherein it spans the air inlet and an open position wherein it permits connection of a suction duct to the air inlet. A handle is provided on the cover. The handle may be gripped when the apparatus is used as a vacuum and may also be gripped to facilitate pivoting the cover when the cover is pivoted between its open and closed positions.

According to another aspect of the invention, the cover has a screened region which extends across the inlet opening when the cover is in the closed position. The inlet opening further comprises a tubular extension which extends axially outwardly from the air inlet of the air-flow duct.

To further increase air flow through the inlet, the tubular extension preferably includes arcuate slots which are disposed about its perimeter. Air then may flow through the arcuate slots directly into the inlet opening.

According to yet another aspect of the invention, a hinge has a first part which is disposed on the cover and a second part which is disposed on the air-flow duct portion of the housing. The first and second parts of the hinge assembly and pivotably connect the cover to the air-flow duct of the housing. The handle of the cover is preferably disposed opposite to the first part of the hinge.

A stationary handle is preferably provided on the housing and is adapted to be gripped when the blower vacuum is used in its blower mode.

The blower vacuum of the present invention may be easily converted to a dedicated blower design by placing a non-pivotable, fixed cover over the air inlet in place of the handle's portable cover. Because the handle used in the vacuum mode is part of the original inlet cover, it can be eliminated along with the original cover itself. This enables production of both a blower vacuum and a dedicated blower without the need for re-tooling the injection mold for the primary housing parts.

These and other advantages of the present invention will become apparent upon review of the attached drawings in light of the following detailed description of the invention.

DETAILED DESCRIPTION OF THE DRAWINGS

Figure 1:
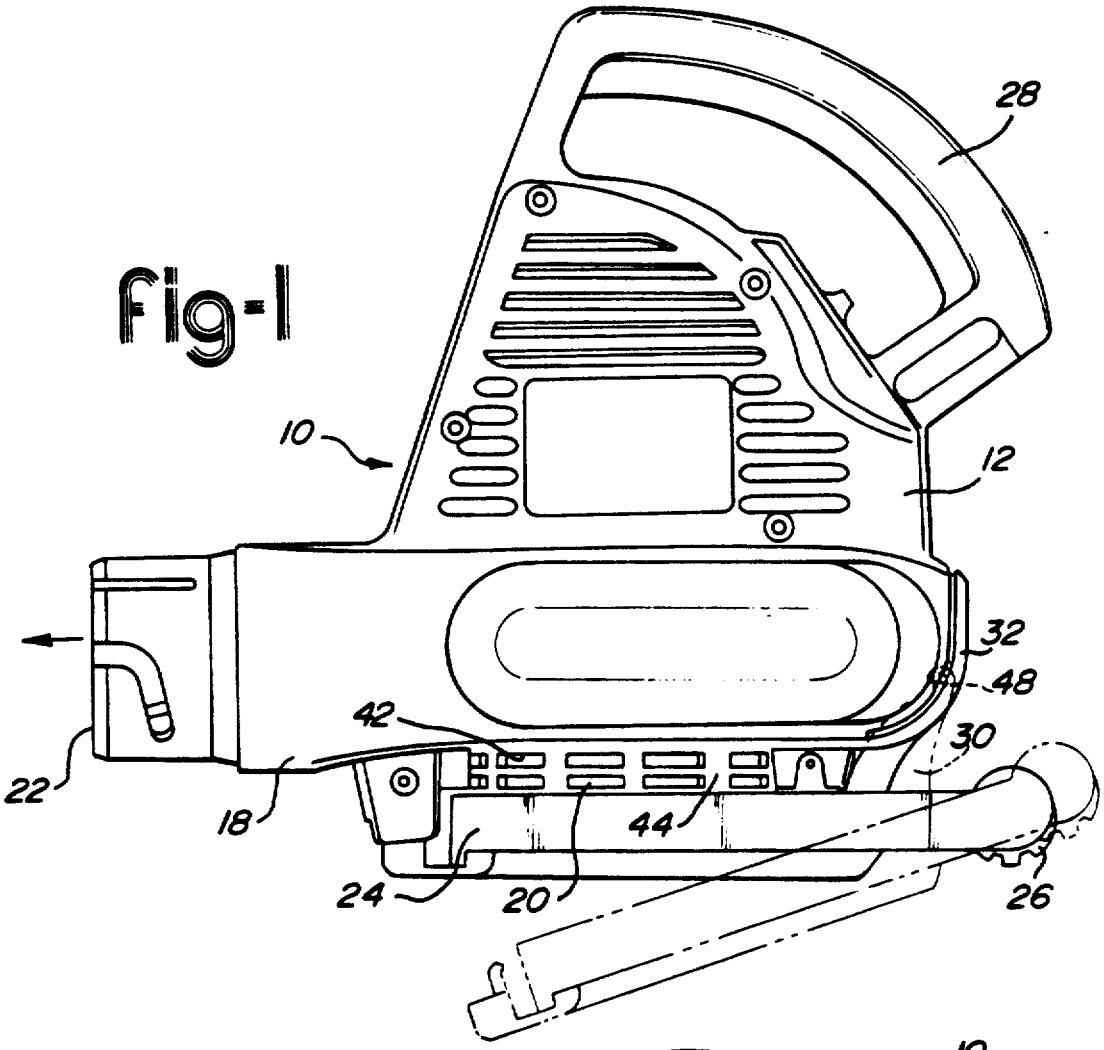
FIG. 1 is a side elevational view of the combination blower and vacuum apparatus of the present invention.

Referring now to FIG. 1, the blower vacuum apparatus 10 of the present invention is illustrated. The blower vacuum apparatus 10 includes a housing 12 for a motor 14 and an impeller 16. The motor 14 drives the impeller 16 to move air through an air-flow duct portion 18 of the housing 12. Air flows from an air inlet 20 through the air-flow duct 18 to an air outlet 22. A cover 24 is provided for the air inlet 20. The cover 24 prevents suction of foreign matter into the air-flow duct 18 when the cover is in place and the apparatus 10 is used in the blower mode. A handle 26 is provided on the cover 24 at the rear end of the housing. The handle 26 is provided to allow for two-handed operation, especially when the device is in its vacuum mode. The handle also is used to assists in opening the cover 24 when converting from the blower mode to the vacuum mode. The handle 26 is easily gripped to allow the cover to be moved to its fully opened position.

A main housing handle 28 is provided on the upper rear portion of the housing. The main housing handle 28 may be gripped by a user when the device is used in either mode and is generally the only handle which must be used when the apparatus 10 is used in the blower mode.

Figure 2:
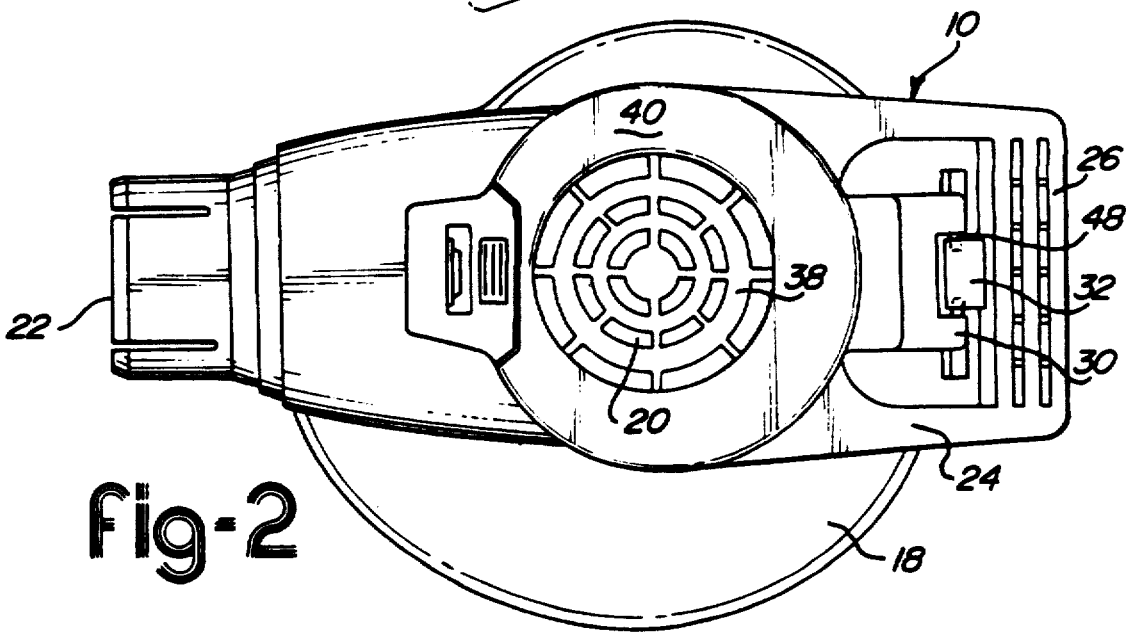
FIG. 2 is a bottom plan view thereof.

Referring now to FIG. 2, the attachment of the cover 24 to the housing 12 is shown from the bottom plan view. A first part of a hinge 30 is preferably formed in between the handle 26 and the cover 24. A second part of the hinge 32 is provided in the air-flow duct portion of the housing 12. The first and second part of the hinge 30 and 32 are assembled to form a hinge connection. The cover 24 may now be pivoted between its opened and closed positions with the handle 26 providing the user with a secure grip on the cover 24 to facilitate the movement.

The first and second parts of the hinge 30 and 32 are interconnected by a pivotably formed or inserted hinge pin 48. The cover pivots about the hinge pin 48 between the closed position shown in FIG. 3 to the open position shown in FIG. 4.

Figure 3:
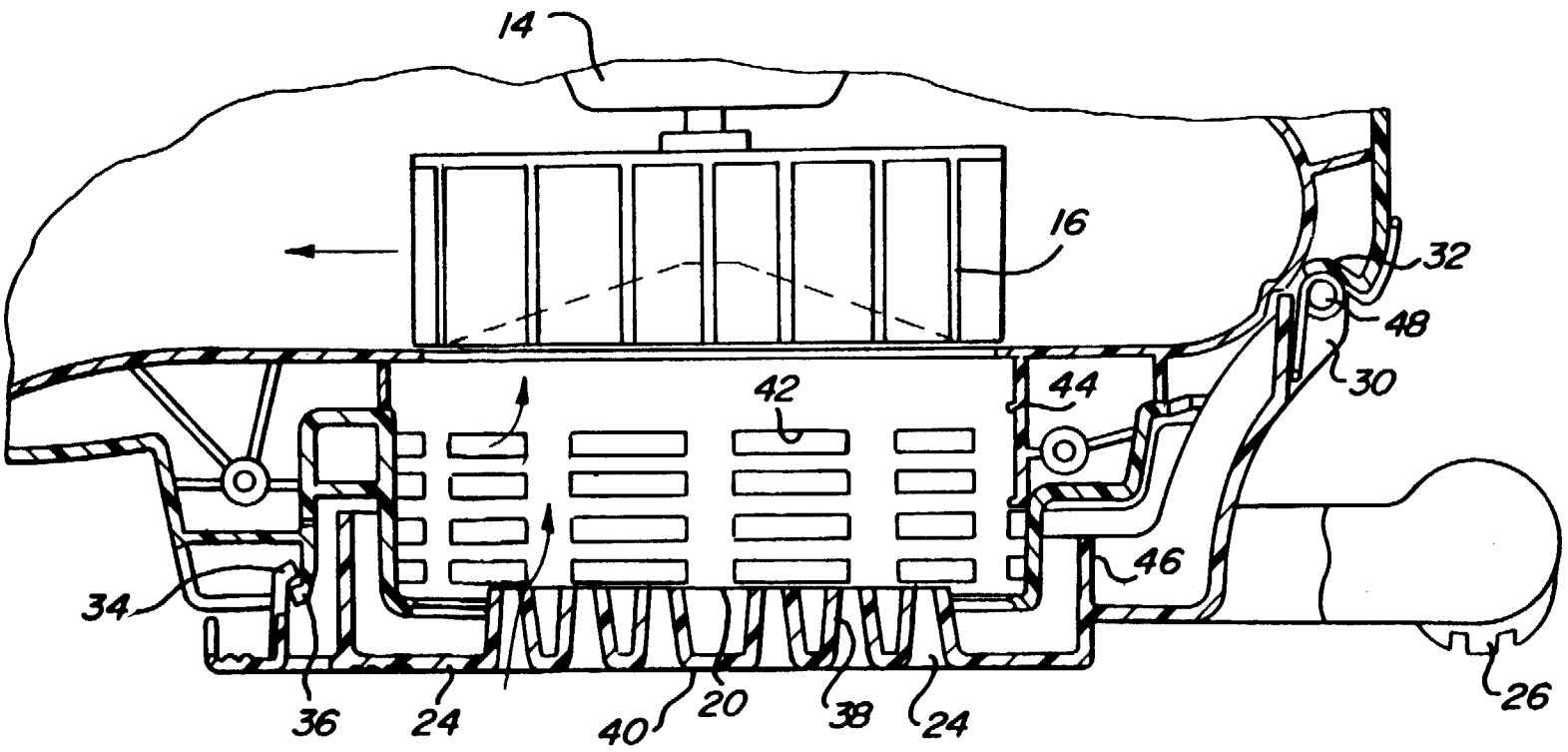
FIG. 3 is a fragmentary cross-sectional view of the lower portion of the housing of the blower and vacuum apparatus and the cover for the air inlet in its closed position.

Also shown in FIGS. 2 and 3 is the finger latch 34 and catch 36 which hold the cover in its closed position. The cover 24 may also have a screen 38 which spans the air inlet 20 so that air may flow axially through the screen 38 and directly into the air inlet 20. The screen 38 is formed in the base wall 40 of the cover 24.

Referring now to FIG. 3, a plurality of arcuate slots 42 are provided in a tubular extension 44 of the air inlet 20. Air flows radially through the slots 42 directly into the air inlet 20. Slots 42 and screen 38 provide the primary air flow into the air inlet 20. Additional air may pass over a circumferentially ex tending rib 46 formed on the cover 24 if desired. This additional air supplements the primary air flow through the slots 42 and screen 38.

Figures 4, 5:
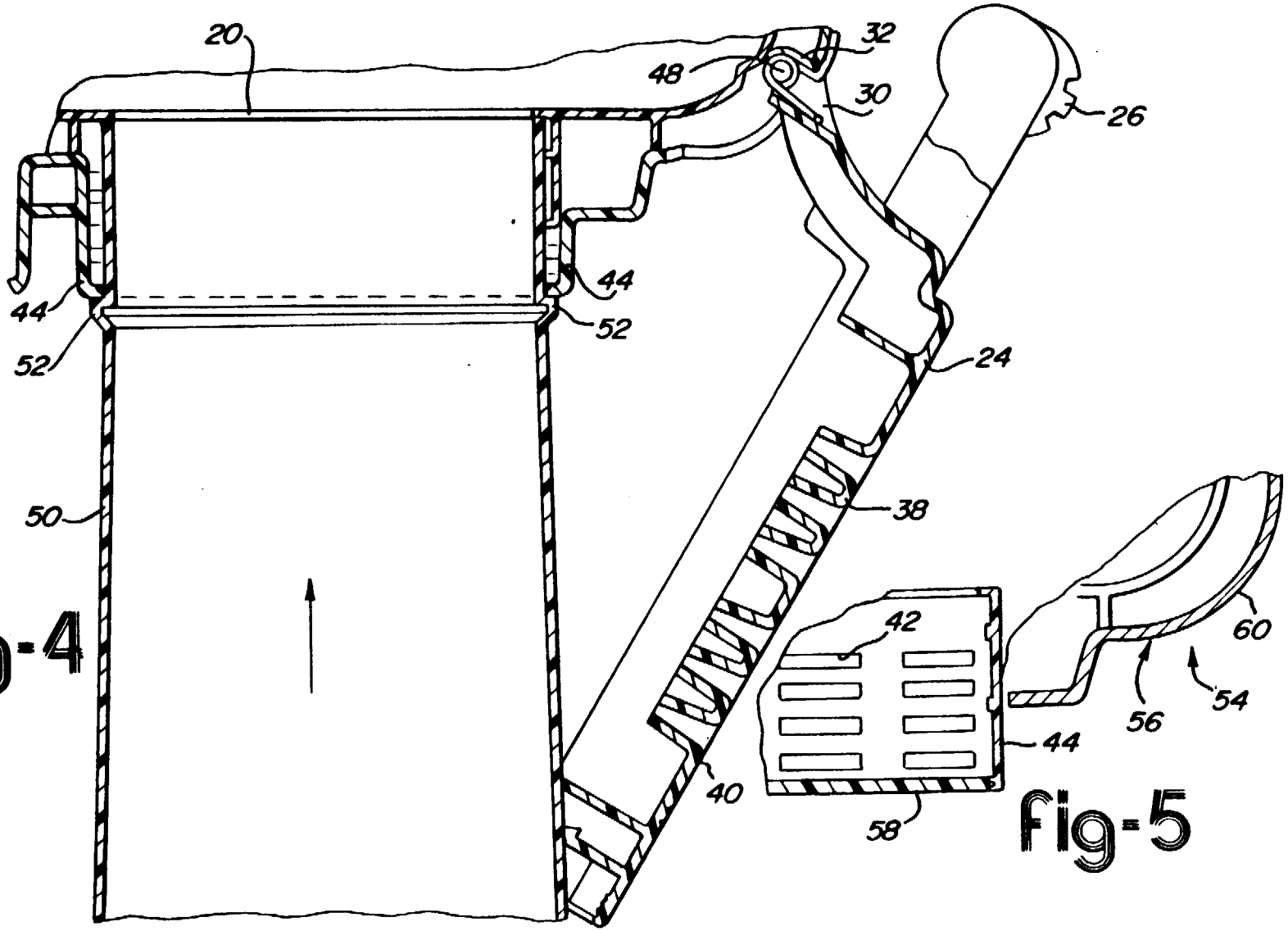
FIG. 4 is a fragmentary cross-sectional view of the lower portion of the housing with the vacuum tube inserted therein and the cover pivoted to the open position.
FIG. 5 is a fragmentary cross-sectional view of the lower portion of the housing of an alternative embodiment of a dedicated blower apparatus where the cover is fixed.

Referring now to FIG. 4, the apparatus is shown fragmentally and includes the vacuum tube 50 inserted in the air inlet 20 with the cover 24 pivoted to its open position. The vacuum tube 50 is inserted into the air inlet until a seat 52 formed on the vacuum tube 50 abuts the tubular extension 44 of the air inlet 20.

Referring to FIG. 5, an alternative embodiment of the invention is shown wherein a fixed cover 54 is secured to the tubular extension 44. The fixed cover embodiment is provided to allow the blower vacuum apparatus 10 of the present invention to be offered as a dedicated blower apparatus. In this manner, it is possible to offer a second product which does not include the cost or features offered by the blower vacuum apparatus without making any significant changes in the primary housing molding 12.

The blower apparatus 54 utilizes the same basic housing 56 as well as the same motor and impeller as the blower vacuum 12. However, by eliminating the cover 24 and its hinge mechanism, it is possible to offer a dedicated blower 54. This feature allows two products to be manufactured utilizing the same basic parts and substituting only the fixed cover 58 in place of the pivotable cover 24. Most preferably, the mold used to form housing 12 has the area forming hinge portion 32 located in a replaceable die segment. When it is desired to make dedicated blower 54 this segment can be removed and a new segment installed to form a smooth exterior surface 60 as illustrated in FIG. 5.

The preceding description of the invention is intended to be explanatory and illustrative of preferred embodiments of the invention and is not to be read in a limiting sense. The scope of the invention should be construed in light of the following claims.

What is claimed is:

1. A hand-held combination blower and vacuum apparatus comprising:

a housing;

a motor disposed in the housing;

an impeller operatively connected to the motor;

an air-flow duct formed in the housing, the air-flow duct enclosing the impeller and having an air inlet comprising a tubular extension extending axially outwardly from the air-flow duct, the tubular extension having a plurality of arcuate slots disposed about the perimeter of the tubular extension to provide air flow into the inlet opening and an air outlet;

a cover for the air inlet pivotably attached on the housing and pivotable between a closed position wherein it spans the air inlet and an open position wherein a vacuum tube can be inserted into the air inlet; and a handle attached to the cover for gripping when the cover is pivoted between the open and closed positions.

2. The apparatus of claim 1 wherein the cover has a screen extending across the inlet opening when the cover is in the closed position.

3. A hand-held combination convertible blower and vacuum apparatus comprising:

a housing having an upper end and a lower end, the housing having a primary handle formed on the upper end of the housing and extending generally vertically upwardly and rearwardly from the upper end of the housing;

a motor disposed in the upper end of the housing;

an impeller operatively connected to the motor;

an air-flow duct formed in the lower end of the housing, the air-flow duct enclosing the impeller and having an air inlet formed in a base planar surface of the lower end of the housing and an air outlet in a front side of the lower end of the housing;

a cover for the air inlet pivotably attached on the lower end of the housing and pivotable between a closed position wherein the cover spans the air inlet and an open position wherein a vacuum tube can be inserted into the air inlet; and a secondary handle attached to the cover and extending in a generally perpendicularly orientation to the primary handle across the width of the housing at the rear side of the lower end of the housing for gripping when the cover is pivoted between the open and closed positions and for providing a second handle for holding the apparatus when used in the vacuum mode of operation to guide movement of a suction duct secured within the air duct.

4. A hand-held combination blower and vacuum apparatus comprising:

a housing;

a motor disposed in the housing;

an impeller operatively connected to the motor;

an air-flow duct formed in the housing, the air-flow duct enclosing the impeller and having an air inlet and an air outlet;

a cover for the air inlet pivotably attached on the housing and pivotable between a closed position wherein it spans the air inlet and an open position wherein a vacuum tube can be inserted into the air inlet the cover having a first part of a hinge and the air-flow duct having a second part of a hinge, the first and second parts being assembled to pivotably connect the cover to the air-flow duct; and a handle attached to the cover for gripping when the apparatus is pivoted between the open and closed positions, the handle being disposed on the opposite side of the first part of the hinge from the cover.

* * * * *

UNITED STATES PATENT AND TRADEMARK OFFICE

CERTIFICATE OF CORRECTION

PATENT NO. : 5,222,275

DATED : June 29, 1993

INVENTOR(S) : Michael Baker, et al

It is certified that error appears in the above-indentified patent and that said Letters Patent is hereby corrected as shown below:

Column 4, Line 56, Claim 3, after "generally" replace "perpendicularly" with --perpendicular--;

Column 4, Line 63, Claim 3, after "air" replace "duct" with --inlet--.

Signed and Sealed this

Sixteenth Day of May, 1995

*Attest:*

*Attesting Officer*

Bruce Lehman

BRUCE LEHMAN

*Commissioner of Patents and Trademarks*